United States Patent [19]

Martin et al.

[11] 4,285,205

[45] Aug. 25, 1981

[54] REFRIGERANT SUB-COOLING

[76] Inventors: Leonard I. Martin, 913 Melvin Dr., N. Bellmore, N.Y. 11710; Robert H. Harms, 129 Clinton St., Malverne, N.Y. 11565

[21] Appl. No.: 105,728

[22] Filed: Dec. 20, 1979

[51] Int. Cl.[3] ..... F25B 41/00

[52] U.S. Cl. ..... 62/113; 62/199; 62/510; 62/513

[58] Field of Search ..... 62/113, 510, 513, 199

[56] References Cited

U.S. PATENT DOCUMENTS 4,151,724 5/1979 Garland ..... 62/513

*Primary Examiner*—Ronald C. Capossela
*Attorney, Agent, or Firm*—Jack Posin

[57] ABSTRACT

Disclosed is a commercial refrigeration system of a type having at least one compressor, a suction header and a liquid header at a central location or machinery center, a condenser and a plurality of remotely located evaporators, wherein a suction-to-liquid heat exchanger is embodied in the suction header of the system and all of the relatively cool gaseous refrigerant returning to the central location from the remotely located evaporators is maintained in heat exchange contact with substantially all of the primary stream of relatively warm liquid refrigerant produced by the operation of the compressor and condenser. The large amounts of relatively warm liquid refrigerant and relatively cool gaseous refrigerant in heat exchange contact with one another enables the centrally located heat exchanger (1) to increase the suction gas temperature going into the suction side of the compressors, which increases their refrigerating capacity, and (2) to usefully sub-cool the liquid refrigerant before it is directed to the expansion valves in order to increase the refrigerant effect and efficiency of the system and cause a corresponding reduction in power requirements.

9 Claims, 3 Drawing Figures

REFRIGERANT SUB-COOLING

The present invention relates generally to commercial refrigeration and air conditioning systems and, more particularly, to a commercial refrigeration of air conditioning system of a type having at least one compressor, one suction header and one liquid header at a central location or machinery center, a condenser and a plurality of remotely located evaporators.

Recently, merchants in various businesses such as supermarkets, warehouses, convenience stores, etc. have been utilizing prior art commercial refrigeration and air conditioning systems of a type having one or more machinery packages or centers and remotely located multiple evaporators to meet their cooling needs. Air conditioning and refrigeration systems are in large part factory preassembled. They normally include a frame or housing at which the machinery or components parts thereof are compactly arranged and mounted. Compressors, condensers, receivers, oil separators, pressure control valves, check valves, filter driers, sight glasses, and various headers for facilitating the flow of liquid between the components are representative of some of the primary and nonprimary refrigeration components normally utilized to form air conditioning and refrigeration systems. These systems may be formed with only one type of primary component part, such as for example, multiple compressors or multiple condensers, or they may be formed with a combination of different types of primary components. They are also customarily significantly prewired and are essentially prepiped to a specific terminal area.

Air conditioning and refrigeration systems employed in supermarkets are usually located in a machinery room and are operatively connected to multiple, remotely located, evaporators. The associated evaporators are installed in cabinets, such as, display cases, walk-in-coolers and storage freezers, located a substantial distance from the machinery room. It is common practice to operate two or more cabinets or evaporators of different suction pressure and/or defrost requirements, each with an expansion valve connected at its inlet, from the machinery center. Frequently, as many as 45 to 50 evaporators and expansion valves are used with the cabinets employed in supermarket applications. In these applications, the multiple evaporators and the associated expansion valves are generally regarded by the refrigeration industry as being remotely located.

A major drawback, however, with such commercial refrigeration systems is that they are frequently provided with numerous small capacity liquid-to-suction heat exchangers. The prior art liquid-to-suction heat exchangers enable heat given up by relatively warm liquid refrigerant, traveling from the receiver to the evaporators by liquid branch lines connected therebetween, to be absorbed by relatively cool vapor, traveling from the evaporators to the compressors by suction branch lines connected between the compressors and the evaporators. The heat of the liquid refrigerant is diminished by an amount equal to the amount of heat taken in by the vapor. The vapor becomes superheated when its temperature becomes higher than the saturation temperature corresponding to the pressure of the vapor. The liquid refrigerant becomes subcooled when it is cooled below the condensing temperature of the liquid refrigerant. Generally, one prior art heat exchanger is associated with one evaporator. The prior art heat exchangers are, traditionally, installed in the liquid branch lines and the suction branch lines adjacent the associated evaporators, and hence, are also generally regarded by the refrigeration industry as being remotely located.

Although the use of such prior art heat exchangers does provide some sub-cooling, they are usually primarily designed to eliminate flash gas which may be present at the inlets of the expansion valves due to any heating of the liquid refrigerant which may occur in long runs of branch piping between the centrally located liquid headers of the machinery center and the remotely located evaporators. Thus, these heat exchangers are generally physically too small to provide useful or beneficial sub-cooling of the liquid refrigerant. Useful sub-cooling of the liquid refrigerant increases the refrigerant effect, or the quantity of heat absorbed in the refrigerated space per unit mass, without increasing the energy input to the compressors which, in turn, increases the efficiency of the system and reduces the power requirements of the system per unit of refrigerating capacity. With the increasingly high cost of energy, there is a need to increase the efficiency of prior art commercial refrigeration systems and, thus, reduce their power requirements by providing useful sub-cooling of the liquid refrigerant.

Prior art attempts to increase the efficiency of such commercial refrigeration systems have generally involved the use of heat exchangers utilizing ambient air. The benefits obtainable in such arrangements are limited since sub-cooling is only available when the ambient air is significantly lower than the designed refrigerant liquid temperature of the system, a condition which usually does not occur during the summer months or during other warm spells.

It is, therefore, a general object of the present invention to provide an improved commercial refrigeration system of the type having remotely located multiple evaporators, which system overcomes the many shortcomings, problems and disadvantages of the previously described prior art commercial refrigeration systems.

It is a more specific object of this invention to provide a commercial refrigeration system of the type previously described in which year-round beneficial sub-cooling of the liquid refrigerant is obtained notwithstanding variations in ambient air temperature.

It is another object of this invention to minimize the need for numerous small capacity remotely located, liquid-to-suction, heat exchangers customarily utilized in the previously described prior art commercial refrigeration systems.

It is yet another specific object of this invention to raise the temperature of the suction gas to the compressor and thus increase its refrigerating capacity.

It is yet another specific object of this invention to sub-cool the refrigerant liquid going to all the remote evaporators, including those that may have just completed a defrost cycle, even though the suction vapor returning from the latter may not be cool enough to sub-cool the liquid supplied thereto.

It is yet another specific object of this invention to substantially improve the efficiency of the aforementioned types of commercial refrigeration systems by providing for improved sub-cooling of the primary stream of liquid refrigerant produced by the operation of the centrally located compressors and the condenser of the refrigeration system.

Further objects and advantages of the invention will become apparent as the following description proceeds.

Briefly stated, and in accordance with one embodiment of this invention, there is provided a commercial refrigeration system, of the type including at least one compressor, one suction header and one liquid header at a central location, a condenser, a plurality of remotely located evaporators and a centrally located heat exchanger. Preferably, the heat exchanger is incorporated in the centrally located suction header of the system by providing internal tubing therein through which the liquid refrigeration is conveyed during its flow from the receiver or condenser to the liquid header of the refrigeration system. The heat exchanger allows substantially all of the relatively cool gaseous refrigerant returning to the central location from the evaporators to be placed into heat exchange relationship with substantially all of the primary stream of liquid refrigerant produced by the operation of the compressors and condensers so as to usefully sub-cool the liquid refrigerant before it flows to the remotely located evaporators and associated expansions valves.

While the specification concludes with claims particularly pointing out and distinctly claiming the subject matter regarded as this invention, it is believed that the invention will be better understood from the following description taken in connection with the accompanying drawings in which:

Figure 1:
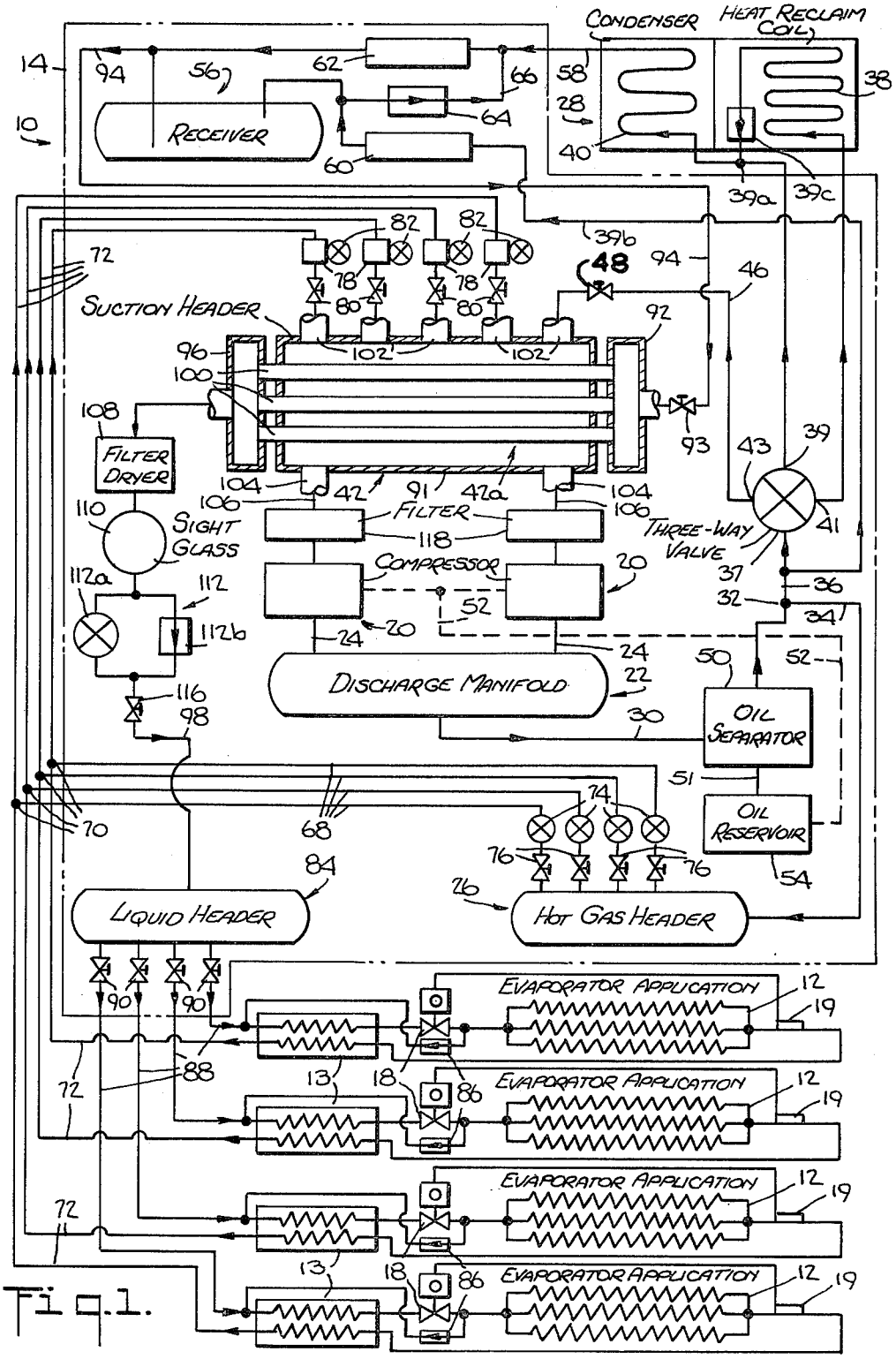
FIG. 1 is a schematic representation of a commercial refrigeration system embodying the invention.
Figures 2, 3:
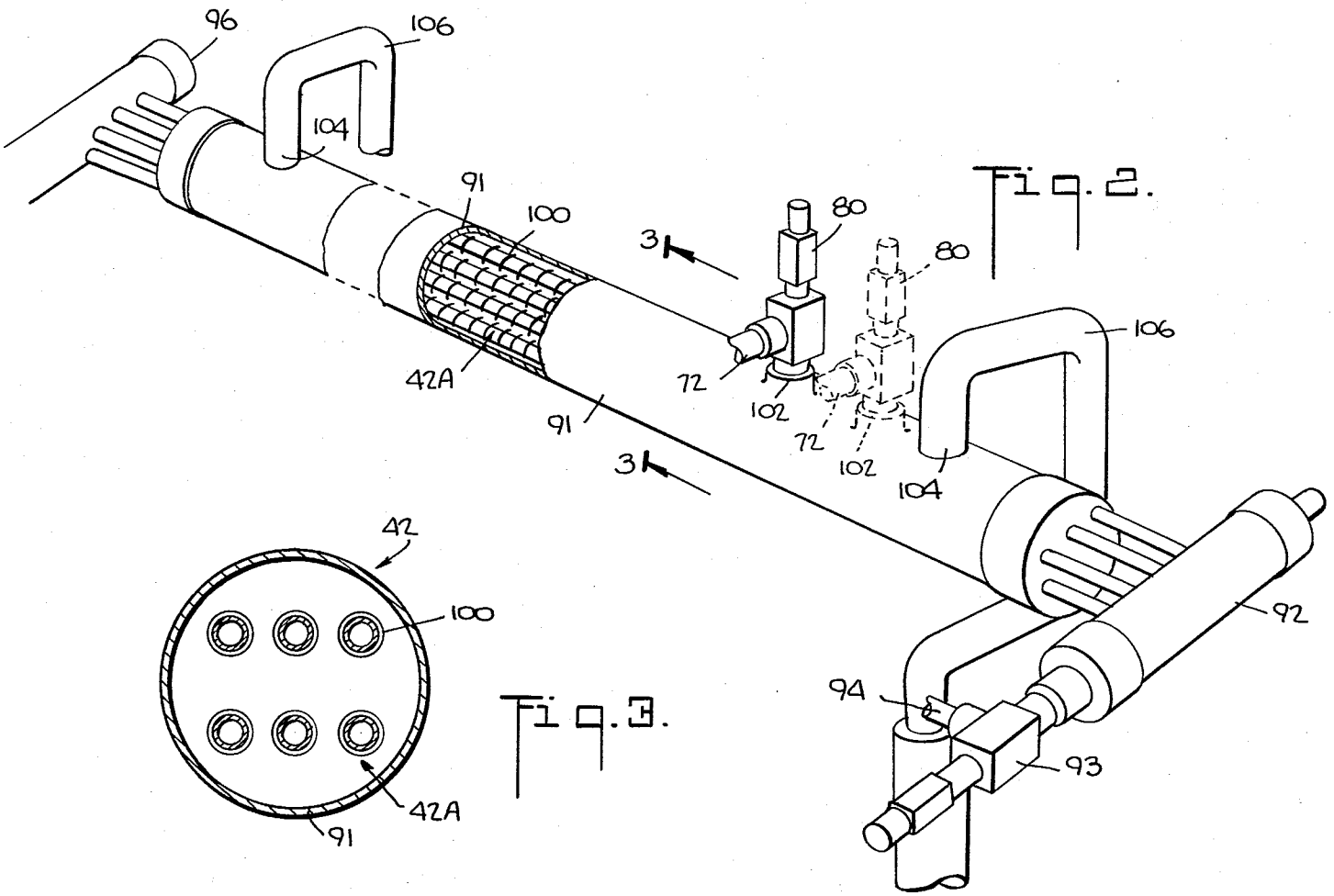
FIG. 2 is a perspective view, partly broken, of a heat exchanger installed in the centrally located suction header of the commercial system schematically illustrated in FIG. 1.
FIG. 3 is an enlarged sectional view of the heat exchanger of FIG. 2, taken along lines 3—3 thereof.

Referring now to FIGS. 1 through 3 of the drawings, a preferred embodiment of a refrigeration system 10 is generally indicated by FIG. 1. Refrigeration system 10 is of a type having a plurality of remotely located multiple evaporators 12. Preferably, system 10 is used in commercial applications such as display cases, walk-in coolers, storage freezers, beverage coolers and other similar type of cabinets, as well as in train cars and truck bodies. It will be appreciated, however, that the refrigeration system 10 of the present invention is not limited solely to commercial applications, as the principles applied herein may also be applied to domestic applications, as will occur to those skilled in the art.

The machinery centers provided by system 10 are largely factory pre-assembled, prewired, and prepiped to a specified terminal area. Since the manner in which this is done forms no part of the present invention, such machinery centers are not herein illustrated in detail. Similarly, for convenience of illustration and discussion, the pre-assembled primary and non-primary refrigeration components of the machinery centers, which are to be regarded as being centrally located, have been enclosed by a broken line, represented by the reference numeral 14. Thus, the components within enclosure 14 represent substantially all of the centrally located components of system 10, while the components outside of enclosure 14 represent substantially all of the remotely located components of system 10. As an example, FIG. 1 indicates that evaporators 12, expansion valves 18 and the prior art type of small capacity, individual heat exchangers 13 are remotely located components since they are shown outside of enclosure 14.

Referring now to the connections between the refrigeration components of the invention, system 10 is provided with conventional multiple-compressors 20 which receive gaseous refrigerant discharged from evaporators 12, via conduits to be described in greater detail hereinafter, and compress it into a smaller volume at a higher pressure. The outlets of compressors 20 are connected to the inlets of a discharge header or manifold 22 by compressor discharge branch lines 24. The compressed gaseous refrigerant flowing from compressors 20 is collected in the discharge header 22 before being further led, via outlet line 30, through an oil separator 50 and "tee" fitting or joint 32 into parallel branch lines 34 and 36. Branch lines 34, 36 lead to a hot gas header 26 and a three way valve 37, respectively, the latter having two selectable outlet parts 39 and 41 which lead to selectable heat exchange coils within a condenser and heat recovery unit 28.

Condenser and heat recovery unit 28 is provided with a first section having a heat reclaim coil 38 and a second section having a condenser coil 40. Heat reclaim coil 38 is operatively positioned in heat exchange relationship in the air stream of an air conditioning system of a known type to provide, during the heating season, heat to the commercial dwelling or environment serviced thereby. When the heat reclaim coil feature is utilized, the three way valve 37 is so positioned that compressed gaseous refrigerant flowing thereto exits from three way valve 37 via outlet part 41, as will be explained more fully herein below. Since the air conditioning system is not part of the present invention, and the manner in which such air conditioning systems are constructed and are operatively associated with heat reclaim coil 38 are well known, it has not been herein illustrated. The second section of condenser and heat recovery unit 28, that is condenser coil 40, is connected to the outlet of reclaim coil 38 and, by a "tee" fitting or joint 39*a*, to the outlet port 39 of three way valve 37.

Three-way valve 37 is installed in discharge branch line 36 upstream of the inlet of condenser and heat recovery unit 28. As indicated earlier, three-way valve 37 enables gaseous refrigerant discharged from discharge manifold 22 to circulate through heat reclaim coil 38 to provide heating for the air conditioning system before passing through condenser coil 40. For example, when port 39 is closed and port 41 is open, relatively hot gaseous refrigerant, superheated by compression, is prevented from directly entering condenser coil 40 by way of port 39. Instead, the hot gaseous refrigerant passes through open port 41 and enters and circulates through heat reclaim coil 38. It then passes into condenser coil 40 via the joint 39*a*. Alternatively, when port 39 is open and port 41 is closed, hot gaseous refrigerant bypasses heat reclaim coil 38, passes through open port 39, and directly enters and circulates through condenser coil 40. A check valve 39*c* is utilized at the downstream end of heat reclaim coil 38 to prevent backflow through the heat reclaim coil when the heating mode of operation is not in use. Three way valve 37 is provided with yet another selectable outlet port 43 which allows evacuation back to a suction header 42 and thence to the suction inputs of compressors 20 of the gaseous refrigerant in the heat reclaim coil 38 when it is not in use. A line 46, having a hand valve 48 installed therein adjacent suction header 42, is employed in the latter flow path for the gaseous refrigerant.

As indicated earlier, an oil separator 50 is installed in discharge header outlet line 30 between discharge manifold 22 and the "tee" joint 32 leading to hot gas header 26 and the three way valve 37. Oil separator 50 removes excessive oil from gaseous refrigerant discharged by multiple compressors 20, which oil could travel with the gaseous refrigerant to unit 28 and, eventually, to the multiple evaporators 12 and decrease the heat transfer efficiencies thereof. The excess oil removed from the gaseous refrigerant by separator 50 is returned to compressors 20 by oil return lines 51 and 52 connected between an outlet of oil separator 50 and the inlets of multiple compressors 20, there being an oil reservoir 54 positioned intermediate lines 51 and 52 which collects the oil separated from the gaseous refrigerant by separator 50 before the oil is returned to the compressors 20. Suitable float level valves (not shown) may be provided in line 52 at the compressor crankcases to maintain proper oil levels in the compressors.

The outlet of condenser coil 40 may be connected to the inlet of a receiver 56, for collecting liquid refrigerant flowing from condenser section or coil 40, by condenser output line 58. A pressure differential valve 60, installed between hot gas discharge branch line 39*b* and receiver 56, and a head pressure control valve 62, installed between condenser output line 58 and a condenser liquid line 94, are employed together to maintain adequate and constant (high-side) receiver pressure during low ambient temperatures, as well as to provide adequate head pressure.

In this arrangement of (high-side) pressure control valves, 60, 62, pressure differential valve 60 responds to changes in pressure differences across it, opening on rise of differential pressure, and, thus, is dependent on the action of head pressure control valve 62. For example, during periods of low ambient temperatures, when condensing pressure falls to the setting of head pressure control valve 62, head pressure control valve 62 then throttles the flow of liquid refrigerant from condenser coil 40 to maintain a suitable head pressure at compressors 20. As head pressure control valve 62 starts to throttle liquid refrigerant flowing from condenser coil 40, a pressure differential is created across pressure differential valve 60. When the opening or setting pressure of differential pressure valve 60 is reached, high-pressure discharge gas is admitted directly to receiver 56 and quickly builds up the receiver pressure. A vent check valve 64 is installed between head pressure control valve 62 and pressure differential valve 60, in line 66 as is clearly illustrated in FIG. 1, to allow pressure equalization in the event that the receiver 56 pressure should tend to raise to a point where it would exceed the condenser 40 pressure. The direction of flow in line 66 is limited to that shown by the arrow head in this line, by valve 64.

Adjustment of head pressure control valve 62 enables the two valves 60, 62 to maintain the desired pressure at both receiver 56 and compressors 20 during normal operation of system 10. It will be appreciated that as long as sufficient refrigerant charge is in system 10, the head pressure control valve 62 and differential pressure valve 60 modulate the flow of refrigerant to maintain adequate (high-side) receiver pressure and head pressure regardless of the ambient temperatures. This is so even though the liquid refrigerant has been significantly sub-cooled during low ambient temperatures.

As indicated earlier, discharge manifold 22 is connected, via lines 34 and 32, oil separator 50 and line 30, to hot gas header 26. Hot gas header 26 functions to collect the high pressure, relatively hot, gaseous refrigerant from discharge header 22 and convey it, in a manner set forth below, to the coils of those of multiple evaporators 12 which are operating in a defrost cycle or defrost mode of operation at any given time. To allow the relatively hot gaseous refrigerant to be conveyed to those evaporators 12 operating in the defrost cycle, multiple outlet branch lines 68 of hot gas header 26 are connected to corresponding multiple "tee" joints 70, installed in suction lines 72 running between the outlets of evaporators 12 and the inlets of suction header 42. A defrost-cycle solenoid valve 74, for automatically opening and closing the branch lines 68 and thereby controlling the flow of relatively hot gaseous refrigerant conveyed to multiple evaporators 12 from hot gas header 26, is installed in each branch line 68. A hand valve 76, for manually controlling the flow of the relatively hot gaseous refrigerant from hot gas header 26 to evaporators 12, is also installed in each branch line 68. Both the defrost-cycle solenoid valve 74 and the hand valve 76 are located adjacent a corresponding outlet of hot gas manifold 26.

An evaporator pressure regulating valve 78 and a hand valve 80 are installed in each branch suction line 72, between each "tee" joint 70 and a corresponding inlet of suction header 42. Hand valves 80 allow manual control of the flow of suction vapor or gaseous refrigerant in branch suction lines 72. The evaporator pressure regulating valves 78 maintain a desired predetermined temperature in the associated evaporator 21, as will be more fully explained hereinafter. Evaporator pressure regulating valves 78 also open and close the suction branch lines 72 for those evaporators 12 which are operating in the cooling or normal cycle or operating in the defrost cycle. To enable the evaporator pressure regulating valves 78 to open and close suction branch lines 72, each pressure regulator 78 is provided with a pilot solenoid 82 which permits the evaporator pressure regulator 78 to serve as a suction-stop valve. Evaporator pressure regulators 78 may be omitted and replaced by suction stop solenoid valves in those evaporator applications which are intended to operate at full suction header pressure.

Evaporator pressure regulator suction-stop pilot solenoid valves 82 operate complementary to defrost-cycle solenoid valves 74 such that selected ones of multiple evaporators 12 can be shut down and defrosted while the remaining evaporators 12 continue to operate in the normal mode of operation. The selected evaporators 12 are defrosted by selectively energizing desired defrost-cycle solenoid valves 74, which causes the valves to open branch lines 68 and convey therethrough relatively hot gaseous refrigerant to those evaporators 12 operating in the defrost-cycle. Suction-stop solenoid valves 82, corresponding to the evaporators 12 selected to operate in the defrost-cycle, would be concurrently deenergized or closed, and, thereby, prevent the relatively hot gaseous refrigerant flowing from hot gas header 26 from entering into suction header 42. The remaining suction-stop pilot solenoid valves 82, associated solely with those evaporators 12 operating in the normal mode, would remain in an energized or open condition, and, thereby, allow the relatively cool gaseous refrigerant flowing from these evaporator coils to enter suction header 42. Solenoid valves 74, corresponding to the evaporators 12 operating in the normal cycle, would remain in a de-energized or closed condition and prevent the relatively hot gaseous refrigerant from flowing into their coils.

Either an electric timer or an evaporator actuated control may be employed in system 10 for activating and deactivating both defrost-cycle solenoid valves and suction-stop pilot solenoid valves 74, 82, respectively, so as to shut down the desired number of evaporators 12 for a desired period of time and for selected intervals of time. The construction and manner in which such controls operate is well known in the art of commercial refrigeration systems.

Multiple evaporators 12 vaporize the liquid refrigerant received from liquid header 84 in a conventional manner, and, in the preferred embodiment, the evaporators are arranged in a plurality of groups of parallel evaporator coils or circuits called "applications." Each group of application contains multiple coils. Each coil is approximately 8 to 12 feet long and is installed in a different remotely located cabinet. A conventional thermostatically controlled expansion valve 18, for automatically regulating the flow of liquid through the coils in each group, is connected at the inlet of each group of evaporators 12. Expansion valves 18 are controlled by corresponding thermal sensors 19, positioned at the evaporator outlets, which sense the temperature of the refrigerant gases exiting from the evaporators and signal the expansion valves to open or close as necessary to maintain the desired temperatures. Suitable conventional evaporator pressure regulating valves 78 are provided which maintain the (low-side) evaporator refrigerant pressure within a desired range relative to the suction pressure existing in the suction header 42, as will be more fully described hereinafter.

A check valve 86 is shunted across each expansion valve 18. Check valves 86 open when their corresponding evaporators are on defrost-cycle to allow liquid refrigerant, condensed from the relatively hot gaseous refrigerant received from hot gas header 26 and circulating within the coils of those evaporators 12, to return to the liquid header 84. Each check valve 86 operates complementary with the associated expansion valve 18 such that one is closed when the other is open. For example, during normal operation of evaporators 12, the associated expansion valve 18 is open and check valve 86 is closed. This allows liquid refrigerant received from condenser coil 40 to flow into evaporator 12 for vaporization. During the defrost cycle, check valve 87 is open and expansion valve 18 is by-passed. This allows the liquid refrigerant condensed from the relatively hot gaseous refrigerant in the evaporator coils to flow around expansion valve 18 and return to liquid header 84. For the latter purpose, the inlet of each expansion valve 18 and the outlet of each associated check valve 86 are connected to liquid header 84 by liquid branch line 88. A hand valve 90, for manually controlling the flow of liquid refrigerant collected and conveyed to evaporators 12 by liquid header 84, is installed in each branch line 88 adjacent an outlet of liquid header 88.

Referring now to the construction of suction header 42 and the refrigeration components directly connected to it, in accordance with the principles of the invention a suction-to-liquid heat exchanger is installed or incorporated in centrally located suction header 42. The heat exchanger is represented by the reference numeral 42A. The liquid refrigerant side of heat exchanger 42A is operatively connected between liquid header 84 and the liquid line 94. The suction side of heat exchanger 42A is operatively connected between compressors 20 and evaporators 12. In the arrangement employed, heat exchanger 42A allows substantially all of the relatively warm primary stream of liquid refrigerant conveyed from liquid line 94 to liquid header 84 and thence to multiple evaporators 12 to be placed in heat exchange contact with substantially all of the relatively cool gaseous refrigerant flowing from evaporators 12 to multiple compressors 20.

Suction header 42 is in the form of an elongated, metal tubular shell or casing 91, as is best illustrated in FIGS. 2 and 3. A first terminal end portion of suction header 42 is provided with an inlet fitting 92 for connecting to the downstream end of liquid line 94. A manual stop valve 93 which is open during normal operation is provided in liquid line 94, adjacent to inlet fitting 92, for securing this line as desired during adjustments and repairs. A second opposed terminal end portion of suction header 42 is provided with an outlet fitting 96 for connecting to the inlet of liquid header 84 (FIG. 1) by line 98. A plurality of heat exchange lines or pipes 100 for conveying therein liquid refrigerant flowing from the liquid line 94 to the liquid header 84 are connected between inlet and outlet suction header fittings 92, 96 such that they extend axially within the interior confines of shell 91. Alternatively, a single heat exchange line or pipe (not shown), having sufficient cross-sectional area to convey therein the full load liquid refrigerant requirement of the system, may be utilized in place of the plurality of pipes 100. In either case the heat exchange pipes would preferably be provided with heat exchange enhancing surfaces, for example fins or spines extending from the outer surfaces thereof, or convolutions formed in the pipes themselves.

Suction header 42 is also provided with a plurality of inboard inlets 102, which are spaced longitudinally along the length of suction header 42, and a plurality of outboard outlets 104. Inlets 102 are connected to corresponding ones of suction branch lines 72 so as to receive the relatively cool gaseous refrigerant discharged from multiple evaporators 12. Outlets 104 are connected to corresponding inlets of compressors 20 by the branch lines 106 which convey gaseous refrigerant collected in suction header 42 to compressors 20. It should be noted that suction header 42 is large enough to act as a suction accumulator and that any liquid refrigerant present in the suction vapor would be vaporized by the heat added thereto by the warm liquid refrigerant flowing through heat exchange pipes 100.

As previously mentioned, evaporator pressure regulating valves 78 maintain desired pressures in their corresponding evaporators and operate in conjunction with their corresponding expansion valves 18 to control the evaporator temperatures. The evaporator pressure regulating valves 78 are physically located adjacent to the inlets 102 of suction header 42. The interrelated operation of the expansion valves 18 and evaporator pressure regulating valves 78 is as follows: When the temperature of the refrigerant gas exiting from an evaporator 12 starts dropping, the temperature sensor 19 associated with that evaporator senses the drop and adjusts the setting of the corresponding expansion valve 18 to reduce the flow of refrigerant to that evaporator. Accordingly, the refrigerant gas pressure in that evaporator tends to drop and the corresponding evaporator pressure regulating valve 78 modulates towards the closed position to throttle suction vapor to compressors 20, thereby maintaining the evaporator pressure within the desired range. Conversely, when the temperature of the refrigerant gas exiting from the evaporator starts rising, the temperature sensor 19 signals the expansion valve to open to increase the flow of refrigerant to the evaporator, raising the pressure on the evaporator. As the evaporator pressure rises, the corresponding evaporator pressure regulating valve 78 modulates towards the open position so that at full load the evaporator pressure is still maintained within the desired range.

It is to be noted that a filter dryer 108 and a sight glass 110 are installed in the liquid line 98 upstream of liquid header 84, and, thus, upstream of the expansion valves 18. Filter dryer 108 acts to catch any contaminants which might flow into branch lines 88 from liquid line 94 and block or plug the passageways of expansion valves 18. Sight glass 110 allows the viewer to determine whether or not moisture is present in the refrigerant. A parallel arrangement 112 of a solenoid valve **112*a* and a spring-loaded check valve 112*b* is also installed in line 98 between liquid line 94 and liquid header 84. During defrost cycling, the solenoid valve 112*a* is closed, causing any refrigerant flowing through the spring loaded check valve 112*b* to have a significant pressure drop. This insures that the condensed refrigerant emanating from defrosting evaporators will be directed to those evaporators which are on a refrigerating cycle. A hand valve 116 may also be installed in line 98 between solenoid valve 112 and liquid header 84. It is to be further noted that a filter 118 is installed in each branch line 106 to catch contaminants which might reach compressors 20** and cause damage thereto.

It will be apparent that utilizing the fairly large centrally located suction header 42 as a large capacity suction-to-liquid heat exchanger 42A enables substantially all of the primary stream of relatively warm liquid refrigerant produced by the centrally located compressors 20 and condenser coil 40 to be in heat exchange contact with substantially all of the relatively cool gaseous refrigerant arriving at the central location from the remotely located multiple evaporators 12. Hence, larger amounts of suction vapor and liquid refrigerant are in heat exchange contact with one another for substantially a longer length of time than heretofore accomplished with the prior art remotely located, small capacity, multiple heat exchangers 13, installed in the liquid branch lines and the suction branch lines adjacent the evaporators. The larger amounts of suction vapor and liquid refrigerant that are caused to be in contact with each other, as well as the greater length of time that the relatively cool suction vapor and the relatively warm liquid refrigerant are in contact with each other, substantially increases the amount of heat exchange between them. Hence, the centrally located heat exchanger 42A of the present invention is enabled to beneficially or usefully sub-cool the liquid refrigerant before it reaches the expansion valves 18 in a manner to significantly increase the refrigerant effect of system 10, in addition to preventing flash gas at the inputs of expansion valves 18.

It will be further apparent that the use of (high-side) pressure control valves 60 and 62 to maintain receiver pressure and head pressure, respectively, regardless of the ambient temperatures, and the use of (low-side) evaporator pressure control valve 78, substantially aids centrally located heat exchanger 42A of the present invention to function in a manner to significantly increase the refrigerant effect over that obtained with the aforesaid prior art small capacity heat exchangers 13 alone. This is accomplished without requiring any increase in energy input to the compressors, thereby, providing system 10 of the present invention with a significant increase in efficiency and a corresponding reduction in power requirements. It is to be noted that the efficiency of system 10 is at least about 6% higher, for every 10° F. of sub-cooling obtained with centrally located large capacity heat exchanger 42A, than the efficiency normally obtained with similar commercial systems using the aforesaid multiple prior art small capacity heat exchangers 13 alone. The beneficial gain in efficiency is realized by system 10 all year around.

A further benefit provided by sub-cooling with the centrally located liquid-to-suction heat exchanger 42A of the present invention is that when evaporators 12 of the present invention are switched from the defrost mode of operation to the normal mode of operation, the full cooling effect of the refrigerant is immediately obtained because sub-cooled refrigerant is employed. In the prior art systems, where remote individual heat exchangers 13 alone are employed, the warmer gaseous refrigerant exiting from a just-defrosted evaporator cannot be used to sub-cool the liquid refrigerant going into that evaporator so that it takes longer to get to a steady state condition and the efficiency is lower.

Yet another benefit provided by centrally located heat exchanger 42A of the present invention is that it superheats the suction vapor returning to compressors 20 from evaporators 12 so as to eliminate the possibility of liquid refrigerant from reaching the compressor inlets which could damage the compressors 20.

Various changes and modifications to the particular disclosed embodiment will now be apparent to those skilled in the art and evidently may be made without departing from the spirit and scope of the invention. By way of example, the large capacity suction-to-liquid heat exchanger 42A may be located at centrally located components of system 10 other than the suction header 42, such as, for example, liquid header 84. Accordingly, the particular embodiment is intended in an illustrative and not in a limiting sense. The spirit and scope of the invention are set forth in the appended claims.

What is claimed is:

1. In a refrigeration system of a type having at least one compressor at a central location, a condenser, a plurality of remotely located evaporators, liquid-side conduit means interconnecting the output of said condenser with the inputs of said evaporators for conducting relatively warm refrigerant liquid from said condenser to the inputs of said evaporators, and suction-side conduit means interconnecting the outputs of said evaporators with the input of said compressor for conducting relatively cool gaseous refrigerant from said evaporator outputs to the input of said compressor, the improvement comprising a liquid-to-suction heat exchanger, said heat exchanger being located at said central location, and the respective conduit means being connected to said heat exchanger so as to allow substantially all of the relatively cool gaseous refrigerant returning to said compressor input from said evaporators to be maintained in heat exchange contact at said central location with substantially all of the relatively warm liquid refrigerant being conducted from said condenser to said evaporator inputs.

2. In a refrigeration system as recited in claim 1, said system further including a suction header and a liquid header at said central location, said suction header being serially positioned in said suction-side conduit means intermediate said evaporator outputs and said compressor input, said liquid header being serially positioned in said liquid-side conduit means intermediate said condenser output and said evaporator inputs, the improvement wherein said heat exchanger is embodied in said suction header, and the liquid-side of said heat exchanger is operatively connected between said liquid header and said condenser output.

3. In a refrigeration system as recited in claim 2, the improvement wherein said liquid-side conduit means passes in fluid tight relation through said suction header to conduct the relatively warm refrigerant liquid into the path of flow of the relatively cool gaseous refrigerant, thereby (i) to vaporize any liquid refrigerant that might be present in said gaseous refrigerant and prevent any such liquid refrigerant from reaching and damaging said compressor and (ii) to sub-cool the liquid refrigerant in said liquid-side conduit means on its way to said evaporator inputs.

4. In a refrigeration system as recited in claim 1, the improvement wherein one of said liquid-side and suction-side conduit means passes in fluid tight relation through said heat exchanger and into the path of flow of the fluid in the other of said conduit means, thereby to sub-cool said relatively warm liquid refrigerant and to superheat said relatively cool gaseous refrigerant.

5. In a refrigeration system as recited in claim 4, said system further including hot gas conduit means interconnecting the output of said compressor with the input of said condenser, defrosting means operatively interconnecting said hot gas conduit means and said suction-side conduit means for selectively disconnecting the outputs of one or more of said evaporators from said suction-side conduit means and connecting said outputs to said hot gas conduit means, said defrosting means permitting said hot gas to flow into and condense in said one or more evaporators thereby to defrost said one or more evaporators while the remaining evaporators remain in their normal refrigerating cycles, and valve means interconnecting said liquid-side conduit means with the input sides of each evaporator to regulate the flow of liquid refrigerant to each evaporator during normal refrigerating cycle operation of such evaporator and to permit the condensate formed in each defrosting evaporator during the defrosting cycle thereof to be conducted to said liquid-side conduit means, the improvement wherein said condensate admixes with said sub-cooled liquid refrigerant in said liquid-side conduit means to form a sub-cooled admixed liquid refrigerant and, upon completion of the defrost cycle at said one or more evaporators and reinstitution of the refrigerating cycle thereat, said sub-cooled admixed liquid refrigerant is conducted to said one or more evaporators.

6. In a method for sub-cooling liquid refrigerant in a refrigeration system of a type having at least one compressor at a central location, a condenser, a plurality of remotely located evaporators, liquid-side conduit means interconnecting the output of said condenser with the inputs of said evaporators, and suction-side conduit means interconnecting the outputs of said evaporators with the input of said compressor, the improvement comprising the steps of:

(a) conducting relatively warm refrigerant liquid from said condenser output to the inputs of said evaporators, (b) conducting relatively cool gaseous refrigerant from said evaporator outputs to the input of said compressor, and (c) maintaining heat exchange contact at said central location between (1) substantially all of the relatively warm liquid refrigerant being conducted from said condenser output to the inputs of said remotely located evaporators and (2) substantially all of the relatively cool gaseous refrigerant being conducted from said remotely located evaporators to the input of said centrally located compressor.

7. In a method for sub-cooling liquid refrigerant as described in claim 6, the improvement wherein the heat exchange contact of step (c) is maintained by passing a portion of one of said conduit means through a portion of the other of said conduit means so that the refrigerant fluid in said one conduit means interacts thermally with the refrigerant fluid in said other conduit means through the walls of said one conduit means, thereby to sub-cool the relatively warm refrigerant liquid on its way to the evaporators and to superheat the relatively cool gaseous refrigerant on its way to the compressor.

8. In a method for sub-cooling liquid refrigerant as described in claim 6, the improvement wherein the heat exchange contact of step (c) is maintained by passing a portion of the liquid-side conduit means through a portion of the suction-side conduit means so that the cool gaseous refrigerant in the suction-side conduit means interacts thermally with the warm refrigerant liquid in the liquid-side conduit means through the walls of the liquid-side conduit means, thereby to sub-cool the relatively warm refrigerant liquid on its way to the evaporators and to superheat the relatively cool gaseous refrigerant on its way to the compressor.

9. In a method for sub-cooling liquid refrigerant as described in claim 6, the refrigerant system including hot gas conduit means interconnecting the output of the compressor with the input of the condenser and defrosting means for directing hot gas to one or more selected evaporators to concurrently defrost said selected evaporators while the remaining evaporators remain in their normal refrigerating cycle, said defrosting means permitting the hot gas condensate formed in said selected evaporators during such defrosting to be conducted to said liquid-side conduit means, the improvement comprising the additional step of:

(d) admixing said condensate with the sub-cooled refrigerant liquid in said liquid-side conduit means to form a sub-cooled admixed liquid refrigerant so that, upon completion of the defrosting cycle of said selected evaporators and reinstitution of the normal refrigerating cycle thereof, said sub-cooled admixed liquid refrigerant is conducted to said one or more selected evaporators.

* * * * *